United States Patent [19]

Sarda

[11] Patent Number: 5,036,762

[45] Date of Patent: Aug. 6, 1991

[54] APPARATUS FOR SUPPLYING OFFSET PRINTING PRESSES WITH A COOLED DAMPING SOLUTION

[76] Inventor: Jean L. Sarda, 48, Avenue Claude Vellefaux, 75010 Paris, France

[21] Appl. No.: 536,975

[22] Filed: Jun. 12, 1990

[51] Int. Cl.[5] ..... B41F 7/26; B41F 7/32; B41L 25/12

[52] U.S. Cl. ..... 101/148; 101/350

[58] Field of Search ..... 101/207, 208–210, 101/364, 363, 147, 148, 350, 351, 366, 355, 356, 360, 361, 365, 347, 315, 321, 326, 330; 118/259, 260, 264

[56] References Cited

U.S. PATENT DOCUMENTS 3,014,421 12/1961 Townsend ..... 101/148

3,352,317 11/1967 Danlgren ..... 101/148 X

*Primary Examiner*—J. Reed Fisher

*Attorney, Agent, or Firm*—James E. Bradley

[57] ABSTRACT

An apparatus for supplying offset printing presses with a cooled damping solution uses a damping tray. The damping tray is subdivided into two distinct portions. A reserve portion contains concentrated solution supplied from a source of damping solution. The distribution solution communicates with a ductor roller. Restrictive holes formed in the partition dividing the two portions of the tray have a flow rate that is directly related to the amount of damping solution being used by the ductor roller in the printing press. This flow rate being very small, allows flow only from the reserve portion into the distribution portion of the tank.

35 Claims, 7 Drawing Sheets

APPARATUS FOR SUPPLYING OFFSET PRINTING PRESSES WITH A COOLED DAMPING SOLUTION

BACKGROUND OF THE INVENTION

1. Field of the Invention:

This invention concerns an apparatus for supplying offset printing presses with a damping solution.

2. Description of the Prior Art:

Offset printing presses use a damping solution during the printing. Large printing presses will have complex equipment for supplying the damping solution. The use of a refrigeration unit to cool the damping solution to about 10 degrees C. offers considerable improvement in quality of the printing. Refrigerating the damping solution, however, adds to the complexity.

The addition of alcohol to the damping solution also provides many advantages. It lowers the surface tension of the solution, which insures that the printing plate is well damped. The alcohol gives a greater affinity of water to ink. Alcohol reduces the emulsification of the ink.

A disadvantage of using alcohol is that the evaporation rate is high, approximately eight times higher than water. This means that it can only be used with cooling units fitted with continual compensation devices. Because of the high price and high evaporation rate, efforts are being made to replace alcohol completely or in part by other agents, such an anionic detergents. Theses detergents lower the surface tension of the damping solution. These agents havve not completely repllaced alcohol, however, which has superior advantages as to quality.

Cooling systems currently available are capable of supplying much more damping solution than is necessary for small or medium format presses. These systems are complex and expensive. As a result, small and medium presses generally do not utilize cooling systems.

The damping trays of existing presses utilize a tray in which a ductor roller is mounted. The ductor roller is partially immersed in the damping solution and is driven. A take-up roller oscillates back and forth into contact with the ductor roller. The take-up roller has a sleeve of sponge like material which receives the damping solution from the ductor roller. The take-up roller oscillates over and distributes the damping solution onto a distributor roller.

While workable, the ductor roller rotating in the solution increases the rate of evaporation of the alcohol. Consequently, the damping solution, although concentrated at the beginning, arrives on the printing plate at a much lower concentration than the basic solution. Also, the solution which is not used by the damping of the printing plate will be transferred back to the damping tray via the ductor roller and the intermediate rollers. This also deconcentrates and contaminates the damping solution contained in the tray.

SUMMARY OF THE INVENTION

In this invention, a special damping tray is provided. The damping tray has a partition in it, which divides the tray into a reserve portion and a distribution portion. A supply source will supply the damping solution to the reserve portion. The partition has small holes through it. The holes allow damping solution from the reserve portion to flow into the distribution portion.

A ductor roller is mounted to the tray in fluid communication with the damping solution in the distribution portion. The flow rate through the small holes in the partition is very restrictive. The flow rate is in only one direction, from the reserve portion to the distribution portion, to make up the fluid depleted by the ductor roll.

In one embodiment, an applicator applies the damping solution to the ductor roll. This applicator is of a soft, sponge like material which extends upward from the tray into contact with the ductor roll. Pressure can be imposed on the applicator to increase or decrease the amount of damping solution being distributed on the ductor roll. Preferably, this pressure can be varied along the length of the applicator. This pressure means comprises in the preferred embodiment a series of individual back plates. Individual screws, one for each back plate, can be rotated to press the separate back plates of the applicator toward the ductor roll at different pressures.

To reduce evaporation, the ductor roller substantially covers the distribution portion of the tray. A cover will cover much of the reserve portion of the tray. For cooling, in two of the embodiments, evaporator coils are mounted to the bottom of the tray, which is insulated. The evaporator coils are supplied with the refrigerant from a refrigeration unit.

DETAILED DESCRIPTION OF THE INVENTION

Figure 1:
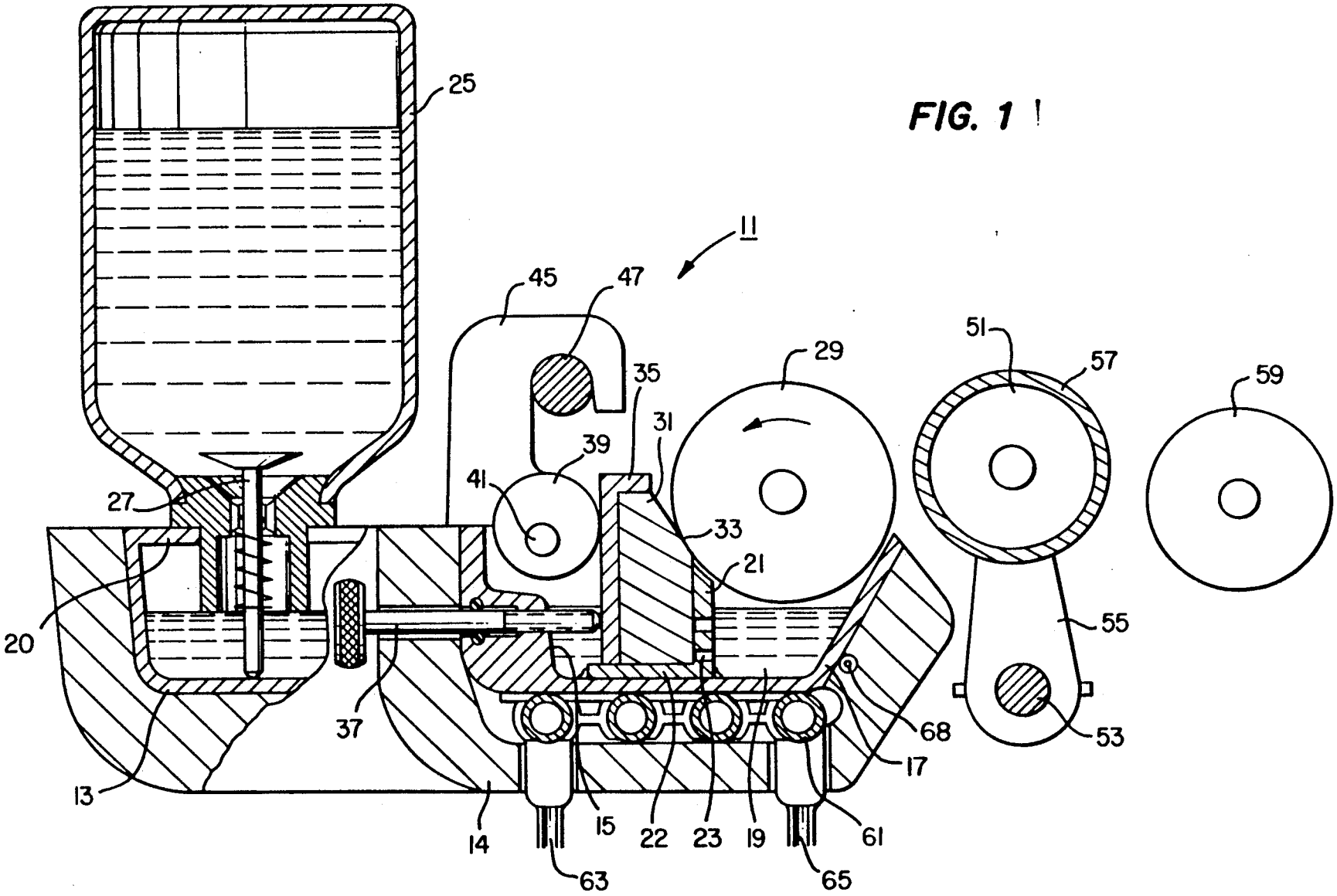
FIG. 1 is a sectional, partially schematic view illustrating a damping solution supplier constructed in accordance with this invention.

Referring to FIG. 1, damping solution supplier 11 has a tray 13. The tray 13 contains an insulation layer 14 on its lower side. Tray 13 has a reserve portion 15 and a distribution portion 17. These portions contain a conventional damping solution 19 for use with printing presses. A cover 20 encloses a large portion of the reserve portion 15.

A partition 21 divides the reserve portion 15 from the distribution portion 17. Partition 21 is a vertical plate extending upward from the bottom of the tray 13 to a height greater than the level of the damping solution 19. Partition 21 has a flat base plate 22 which is welded to the bottom of the reserve portion 15 in the embodiment shown.

The partition 21 has means for allowing flow of damping solution 19 from the reserve portion 15 into the distribution portion 17, and for preventing substantially all flow in the opposite direction. This comprises a plurality of small holes 23 which are located in the partition 21. The holes 23 are of a fairly small diameter, such as five tenths of a millimeter, to allow only a restrictive flow rate.

The source of supply of the damping solution 19 in the embodiment of FIG. 1 is a storage bottle 25. Storage bottle 25 has a valve 27 which opens when the bottle 25 is inverted and brought into position in a receptacle on the cover 20 of the tray 13. This allows the damping solution 19 to flow into the tray 13, and to maintain a constant level in a conventional manner. When the level of the damping solution 19 drops in the tray 13, the storage bottle 25 will allow more damping solution 19 to flow into the tray 13.

A ductor roller 29 is driven by the printing press and is mounted to the tray 13. In the embodiment of FIG. 1, the ductor roller 29 is located entirely above the design level of the damping solution 19.

An applicator 31 with an inclined face 33 locates in the damping solution 19. Applicator 31 is of a porous mesh, foam, or sponge like material for soaking up damping solution 19. Solution 19 will wick upward to the inclined face 33, which is located above the level of the damping solution 19. The face 33 contacts the rotating ductor roller 29. Ductor roller 29 engages the face 33 in sliding contact. Applicator 31 is secured in the tray 13, with a front wall in contact with the partition 21 and a bottom in contact with the base plate 22.

Means exist for varying the pressure of the applicator 31 against the ductor roller 29. Increased pressure will cause more of the damping solution to be deposited on the ductor roller 29. The pressure means in the preferred embodiment comprises a series of back plates 35. Back plates 35, shown in FIGS. 2 and 3 comprise a plurality of upright plates, each spaced side-by-side along the length of the applicator 31. The length of the applicator 31 will be substantially the length of the ductor roller 29. Back plates 35 are not fastened to each other and are bonded to the applicator 31. The back plates 35 may be individually pushed forward, or allowed to spring backward due to the resiliency of the applicator.

Figure 2:
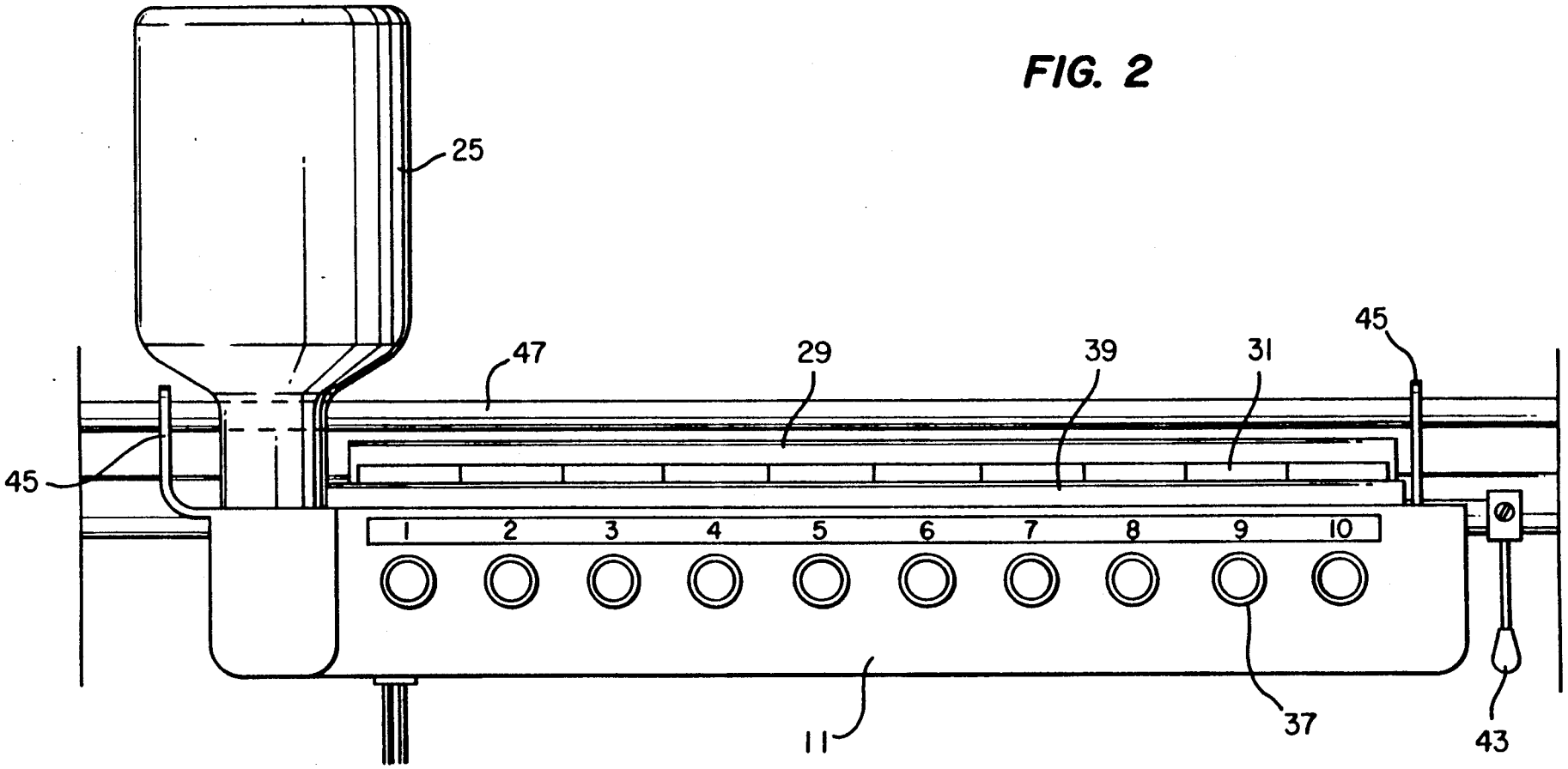
FIG. 2 is an end view of the damping solution supplier of FIG. 1.
Figure 3:
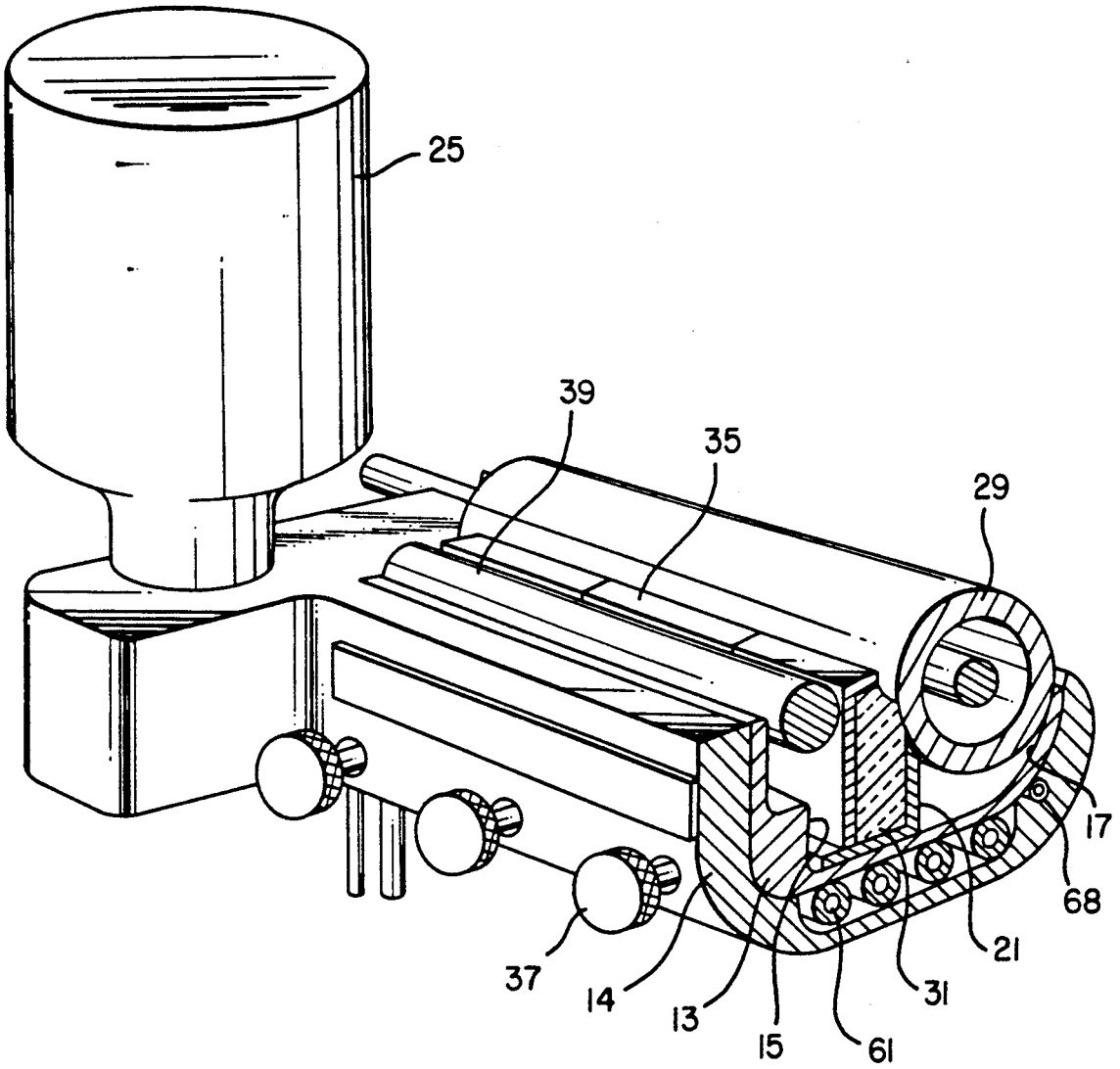
FIG. 3 is a partial perspective view of the damping solution supplier of FIG. 1.

The means for varying the pressure on the back plates 35 comprises a screw 37 for each of the back plates 35, as shown in FIGS. 2 and 3. Each screw 37 secures to a threaded hole in the tray 13. One end of each screw 37 will abut each of the back plates 35. Each screw 37 has a knurled knob to allow the user to rotate the screw to position each back plate 35 as desired. The pressure of the applicator 31 can thus be varied along its length. This allows the user to vary the amount of damping solution 19 applied to various places along the length of the ductor roller 29.

The means for applying pressure on the back plates 35 also includes a cam 39. Cam 39 is an elongated rod having an eccentric pivot point 41. A handle 43, shown in FIG. 2, allows a user to rotate the cam. Cam 39 extends the full length of the applicator 31. When rotated in one direction, the cam 39 will push the back plates 35 forward, and when rotated in the other direction, allow them to spring rearward. This movement will be in unison for all of the plates 35.

Figure 4:
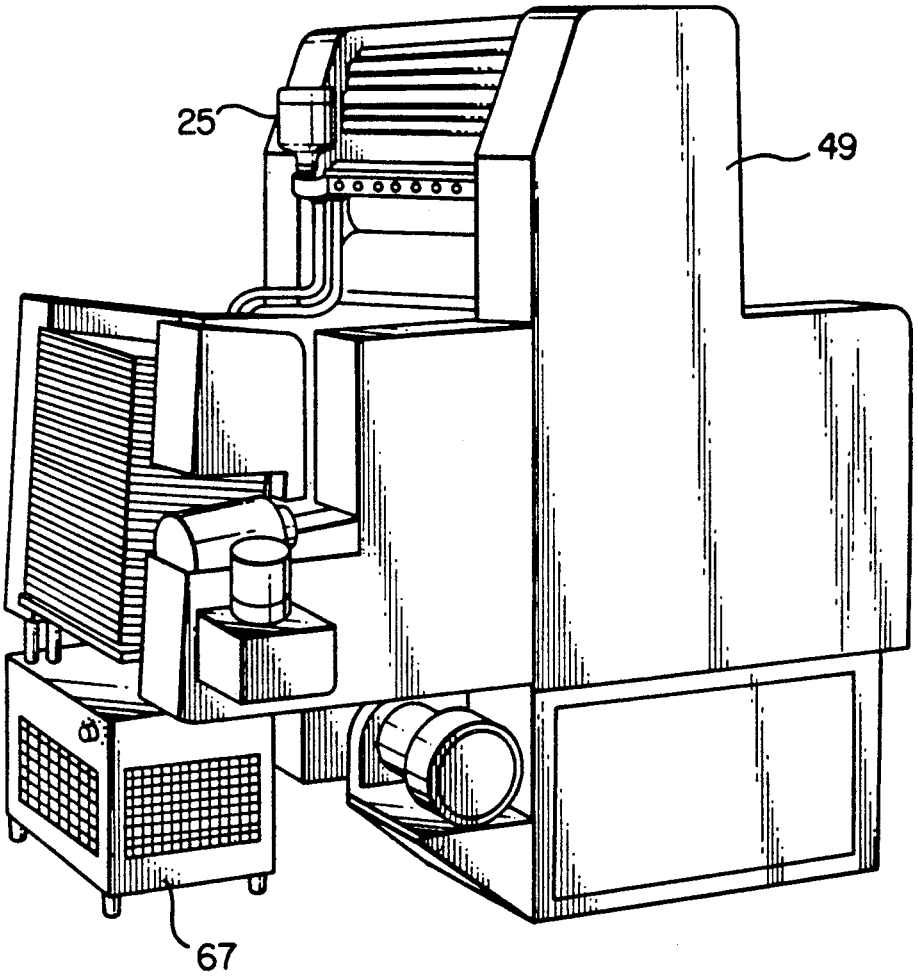
FIG. 4 is a perspective view of a printing press having the damping solution supplier of FIG. 1 installed thereon.

Referring again to FIG. 1, a plurality of hooks 45 mounted to the damping solution supplier 11 will support the supplier 11 on a conventional rod 47 of a printing press 49 (FIG. 4). The printing press 49 will have a take-up roller 51. The take-up roller 51 is mounted to a pivot rod 53 by means of levers 55. The levers 55 and pivot rod 53 cause the take-up roller 51 to oscillate. A sleeve 57 on the take-up roller 51 absorbs damping solution 19 that it receives from the ductor roller 29 when the take-up roller 51 oscillates over into contact with the ductor roller 29.

The take-up roller 51 will apply the damping solution to a distributor roller 59. The distributor roller 59 will apply the solution to a printing plate (not shown) in a conventional manner.

Means exists for chilling the damping solution 19 to about ten degrees C. In the embodiment of FIG. 1, this means comprises a set of evaporator coils 61. Coils 61 extend beneath the tray 13. The coils 61 are in contact with the bottom of the tray 13 and are insulated by insulation layer 14. The coils 61 have an inlet 63 and an outlet 65. The inlet 63 and outlet 65 lead to a conventional refrigeration unit 67, shown in FIG. 4. The refrigeration unit 67 supplies a cooled refrigerant to the evaporator coil 61. A thermostat probe 68 monitors the temperature of the tray 13 and controls the refrigeration unit 67.

In the operation of the embodiment of FIGS. 1-4, the damping solution 19 will be proVided by storage bottle 25 to the tray 13. The damping solution 19 will flow from reserve portion 15 into distribution portion 17, and achieve a constant uniform level. The damping solution 19 will wick up the applicator 31 into contact with the ductor roller 29. The ductor roller 29 is rotated by the printing press 49 (FIG. 4). The user can vary the amount of damping solution 19 placed on the ductor roller 29 by rotating the screws 37. Furthermore, the user can increase the damping solution or decrease it uniformly across the ductor roller 29, by rotating the cam 39.

The take-up roller 51 will oscillate over into contact with the ductor roller 29 to pick up damping solution 19. The take-up roller 51 will then oscillate into contact with the distributor roller 59 to distribute the solution. Some of the damping solution 19 will be depleted during this operation, although some damping solution returns back to the ductor roller 29 after use in the printing press. The alcohol concentration of the returning damping solution 19 will be less because than desired because of evaporation during use in the printing press 49.

Liquid damping solution 19 will flow out of the bottle 25 to replenish the amount depleted. The small size of the holes 23 in partition 21 allow just enough flow to replenish and maintain a constant level in the distribution portion 17. The flow rate is not sufficiently high, however, to allow flow from the distribution portion 17 back into the reserve portion 15. The flow rate is only sufficient to make up or replenish the damping solution 19 lost from the ductor roller 29. The concentration of alcohol in the damping solution 19 in the distribution portion will remain stable because of the introduction of replenishing damping solution 19 from reserve portion 15.

The ductor roller 29 will pick up contaminates from the printing press 49 through its contact with the take-up roller 51, which contacts the distributor roller 59. This contaminates will be wiped off the ductor roller 29 by the applicator 31, and prevented from returning back to the take-up roller 51. The proper selection of pressure on the applicator 31 will prevent any dripping of the ductor roller 29 into the distribution portion 17.

The tray 13 is substantially covered from the atmosphere to reduce evaporation. The ductor roller 29 fits closely into the upper portion of the distribution portion 17 of the tray 13. Only a slight gap exists to avoid sliding contact of the ductor roller 29 with the tray 13. Ductor roller 29 thus acts as a cover.

Cover 20 on the reserve portion 15 covers a great deal of the reserve portion 15. The cam 39 covers another portion of the reserve portion 15. Cover 20 and cam 39 block substantially all of the reserve portion 15 from atmosphere, thereby reducing evaporation of the alcohol in the damping solution 19.

Figure 5:
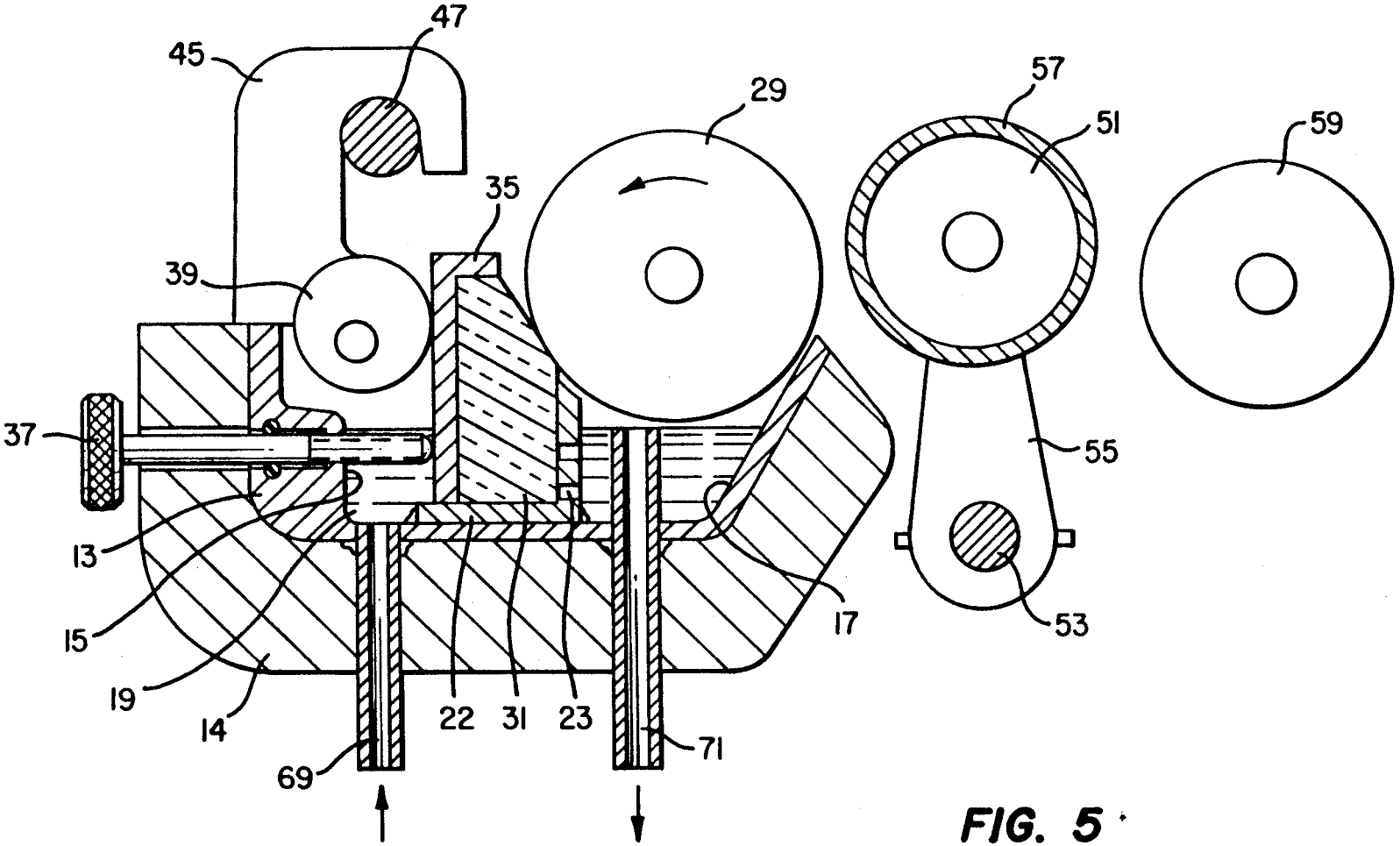
FIG. 5 is a sectional, partially schematic view, illustrating a first alternate embodiment of a damping solution supplier constructed in accordance with this invention.

In the embodiment of FIG. 5, many of the elements which are substantially the same as that of FIG. 1 are shown with the same numeral, and not necessarily mentioned again. The embodiment of FIG. 5 differs in that it does not use a storage bottle 25, shown in FIG. 1. Also, the damping solution supplier of FIG. 5 does not use evaporator coils 61 mounted below the tray 13.

Instead, the damping solution 19 will be chilled in a separate unit. This damping solution 19 will be supplied through inlet 69 to the reserve portion 15 of tray 13. An overflow tube 71 will cause overflow from distribution portion 17 to return back to the refrigeration unit. Tube 71 maintains a constant level in the tray 13. The refrigeration unit will be similar to the refrigeration unit 67, but it will have a heat exchanger for cooling the damping solution, and it will have a pump for pumping the damping solution 19.

Figure 6:
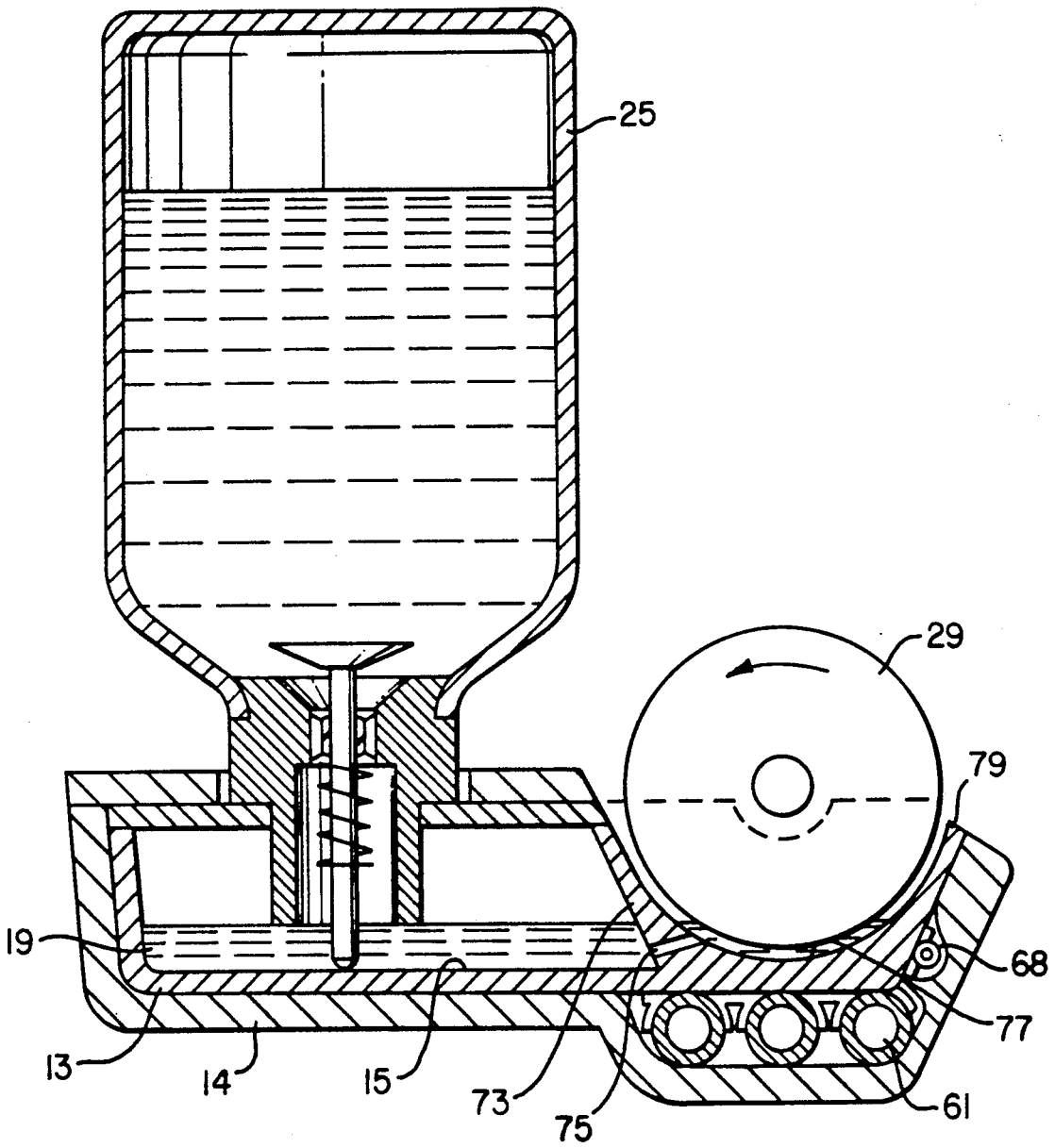
FIG. 6 is a cross-sectional, partially schematic view of a second alternate embodiment of a damping solution supplier constructed in accordance with this invention.

The embodiment of FIG. 6 also uses the same numerals as that of FIG. 1 for many of the elements which are similar. In this embodiment, partition 73 is similar to partition 21 of FIG. 1, except that it has a concave upper surface. The holes 75 are similar to the holes 23 in FIG. 1. The concave or arcuate upper surface of partition 73 forms a part of a concave upward facing bottom 77 of distribution portion 79. The radius of curvature of the arcuate bottom 77 is only slightly greater than the radius of ductor roller 29. The ductor roller 29, rather than using an applicator 31, has a lower portion immersed in damping solution 19 contained within the distribution portion 79.

The amount of damping solution 19 required in the distribution portion 79 is very small because of the concave bottom 77. During usage, the damping solution 19 in the distribution portion 79 will become deconcentrated because of the return of damping solution back to the distribution portion 79 via the ductor roller 29 from contact with the take-up roller 51 (FIG. 1). Some alcohol will have evaporated from the returning damping solution during use in the printing press. The small volume in the distribution portion 79 allows the damping solution 19 in the distribution portion 79 to rapidly return back to the proper concentration by new damping solution 19 flowing through holes 75.

Figure 7:
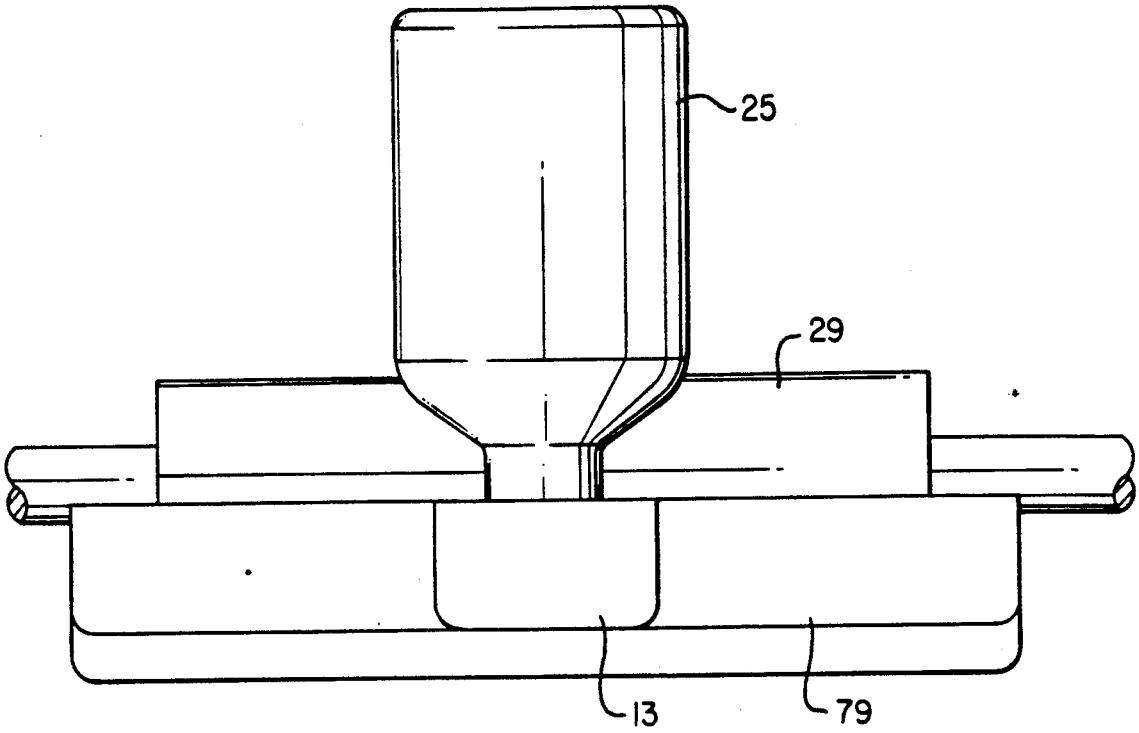
FIG. 7 is an end view of the damping solution supplier of FIG. 6.
Figure 8:
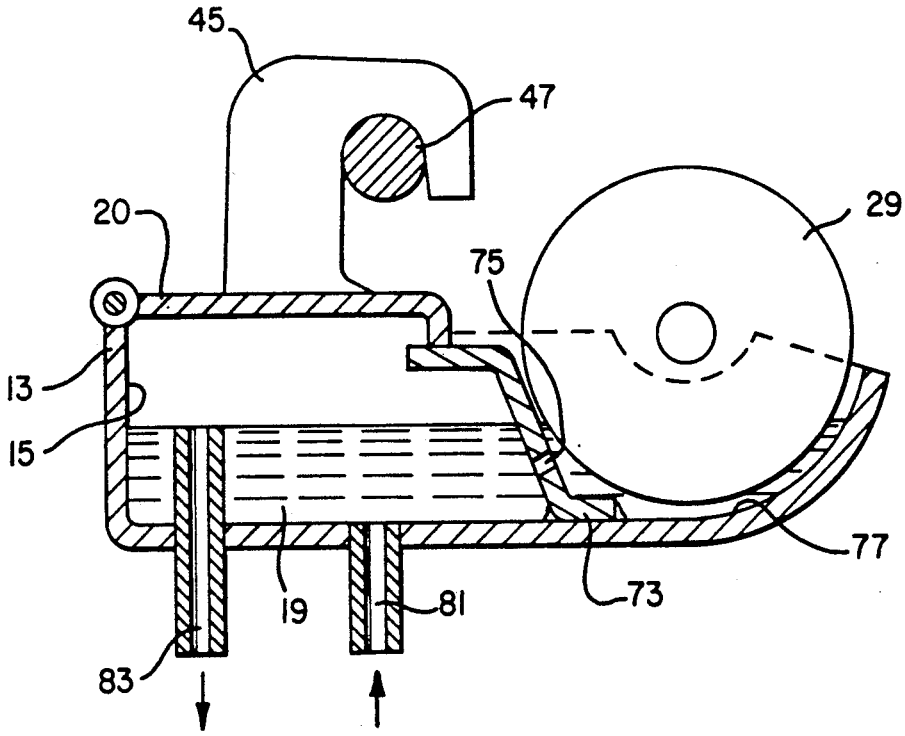
FIG. 8 is a third alternate embodiment of a damping solution supplier constructed in accordance with this invention.

The embodiment of FIG. 8 is the same as the embodiment of FIG. 7, except that it does not have a storage bottle 25. Nor does it have evaporator coil 61. Instead, the damping solution 19 will be supplied from an external pump (not shown) to an inlet 81. An overflow tube or outlet 83 leads back to the pump.

The invention has significant advantages. The separate portions of the tray enable the establishment and the maintenance of a stable balance of concentration of damping solution. The units can be used with medium and small presses. Contaminates picked up by the ductor roller are isolated from the reserve portion, avoiding polluting the entire tray with contaminates. The restrictive holes in the partition maintain the proper concentration of damping solution in the distribution portion by allowing concentrate to flow only from the reserve into the distribution portion and not the reverse.

While the invention has been shown in only four of its forms, it should be apparent to those skilled in the art that it is not so limited, but is susceptible to various changes without departing from the scope of the invention.

I claim:

1. An apparatus for supplying a damping solution to a take-up roller of a printing press, comprising in combination:

a damping tray;

partition means in the damping tray for dividing the damping tray into a reserve portion and a distribution portion;

means for supplying a damping solution to the reserve portion of the tray;

passage means in the partition means for allowing flow of the damping solution from the reserve portion into the distribution portion and for preventing substantially all flow of damping solution from the distribution portion back into the reserve portion; and a driven ductor roller mounted to the damping tray, in fluid communication with damping solution in the distribution portion and adapted to be engaged by the take-up roller to transfer damping solution received from the distribution portion to the take-up roller.

2. The apparatus according to claim 1 wherein the passage means has a flow area selected to be sufficiently small so that flow through the passage means occurs only into the distribution portion to replenish the damping solution used by the ductor roller as it applies damping solution to the take-up roller.

3. The apparatus according to claim 1 wherein the ductor roller extends over substantially all of the distribution portion of the tray to reduce evaporation of any constituents in the damping solution.

4. The apparatus according to claim 1 wherein the ductor roller extends over substantially all of the distribution portion of the tray to reduce evaporation of any constituents in the damping solution contained in the distribution portion, and wherein the apparatus further comprises:

means for covering substantially all of the reserve portion of the tray to reduce evaporation of any constituents in the damping solution contained in the reserve portion.

5. The apparatus according to claim wherein the partition means comprises a plate extending across the tray, and the passage means comprises a plurality of holes through the plate.

6. The apparatus according to claim 1 wherein the ductor roller is mounted to the tray entirely above the normal level of damping solution in the distribution portion, and wherein the apparatus further comprises:

an applicator stationarily mounted in the tray, immersed in the damping solution and extending above the level of damping solution in the distribution portion in continuous engagement with the ductor roller, the applicator being of a porous material for soaking up damping solution and distributing damping solution onto the ductor roller.

7. The apparatus according to claim 1 wherein a portion of the ductor roller is partially immersed in the distribution portion of the tray.

8. The apparatus according to claim 1 further comprising refrigerant means mounted to the tray for cooling damping solution contained in the distribution of the tray.

9. The apparatus according to claim 1 further comprising a refrigerant evaporator coil mounted to the tray below the bottom of the tray for cooling damping solution contained in the tray.

10. An apparatus for supplying a damping solution to a take-up roller of a printing press, comprising in combination:

a damping tray;

partition means in the damping tray for dividing the damping tray into a reserve portion and a distribution portion;

means for supplying damping solution to the reserve portion of the tray;

passage means in the partition means for allowing flow of the damping solution from the reserve portion into the distribution portion;

a driven ductor roller mounted to the damping tray above the level of damping solution in the distribution portion and adapted to be engaged by the take-up roller to transfer damping solution from the distribution portion to the take-up roller; and an applicator stationarily mounted in the reserve portion of the tray, immersed in the damping solution and extending above the level of damping solution in the distribution portion in continuous sliding engagement with the ductor roller, the applicator being of a porous material for soaking up damping solution and distributing damping solution onto the ductor roller.

11. The apparatus according to claim 10 further comprising:

pressure means for adjustably pressing the applicator against the ductor roller to vary the amount of damping solution applied to the ductor roller by the applicator.

12. The apparatus according to claim 11 wherein the pressure means comprises:

at least one substantially rigid back plate mounted to the applicator opposite the point of contact of the applicator with the ductor roller; and means for pushing the back plate toward the ductor roller to compress the applicator.

13. The apparatus according to claim 11 wherein the pressure means comprises:

a plurality of back plates mounted to the applicator, side-by-side and opposite the point of contact of the applicator with the ductor roller; and means for pushing each back plate toward the ductor roller independently of the other back plates to compress the applicator to selected different degrees along the length of the applicator.

14. The apparatus according to claim 10 further comprising:

pressure means for adjustably pressing the applicator against the ductor roller to different selected degrees along the length of the applicator to vary the amount of damping solution applied to the ductor roller by the applicator.

15. The apparatus according to claim 10 wherein the applicator has a front wall in engagement with the partition means.

16. The apparatus according to claim 10 wherein the passage means prevents substantially all flow of damping solution from the distribution portion back into the reserve portion.

17. The apparatus according to claim 10 wherein the passage means has a flow area selected to be sufficiently small so that flow through the passage means occurs only into the distribution portion to replenish the damping solution used by the ductor roller as it applies damping solution to the take-up roller.

18. The apparatus according to claim 10 wherein the ductor roller extends over substantially all of the distribution portion of the tray to reduce evaporation of any constituents in the damping solution.

19. The apparatus according to claim 10 wherein the ductor roller extends over substantially all of the distribution portion of the tray to reduce evaporation of any constituents in the damping solution contained in the distribution portion, and wherein the apparatus further comprises:

means for covering substantially all of the reserve portion of the tray to reduce evaporation of any constituents in the damping solution contained in the reserve portion.

20. The apparatus according to claim 10 wherein the partition means comprises a plate extending across the tray and the passage means comprises a plurality of holes through the plate.

21. The apparatus according to claim 10 further comprising refrigerant means mounted to the tray for cooling damping solution contained in the distribution portion of the tray.

22. The apparatus according to claim 10 further comprising a refrigerant evaporator coil mounted to the bottom of the tray for cooling damping solution contained in the tray.

23. An apparatus for supplying a damping solution to a take-up roller of a printing press, comprising in combination:

a damping tray;

a partition in the damping tray, dividing the damping tray into a reserve portion and a distribution portion;

means for supplying damping solution to the reserve portion of the tray;

a plurality of holes in the partition for allowing flow of the damping solution from the reserve portion into the distribution portion;

a driven ductor roller mounted to the damping tray above the level of damping solution in the distribution portion and adapted to be engaged by the take-up roller to transfer damping solution from the distribution portion to the take-up roller;

an applicator stationarily mounted in the reserve portion of the tray, immersed in the damping solution and extending above the level of damping solution in the distribution portion, the applicator extending along the length of the ductor roller and having a front portion in continuous sliding engagement with the ductor roller, the applicator being of a resilient porous material for soaking up damping solution and distributing damping solution onto the ductor roller;

a plurality of back plates mounted to the applicator, side-by-side and opposite the front portion of the applicator; and force means for pushing each back plate toward the ductor roller independently of the other back plates to compress the applicator to selected different degrees along the length of the ductor roller.

24. The apparatus according to claim 23 wherein the force means comprises:

a plurality of screws, each mounted to threaded holes in the tray and with an end in contact with one of the back plates so that rotation of each screw in one direction moves one of the back plates toward the ductor roller.

25. The apparatus according to claim 23 wherein the force means comprises:

a plurality of screws, each mounted to threaded holes in the tray and with an end in contact with one of the back plates so that rotation of each screw in one direction moves one of the back plates toward the ductor roller;

a cam eccentrically mounted adjacent the back plates and extending the length of the applicator; and means for rotating the cam to push all of the back plates toward the ductor roller in unison, except for any back plates held in a closer position to the ductor roller by any of the screws.

26. The apparatus according to claim 23 wherein the applicator has a front wall in engagement with the partition.

27. The apparatus according to claim 23 wherein the each of the holes in the partition has a cross sectional size selected to be sufficiently small so that flow through the holes occurs only into the distribution portion to replenish the damping solution used by the ductor roller as it applies damping solution to the take-up roller.

28. The apparatus according to claim 23 wherein the ductor roller extends over substantially all of the distribution portion of the tray to reduce evaporation of any constituents in the damping solution.

29. The apparatus according to claim 23 wherein the ductor roller extends over substantially all of the distribution portion of the tray to reduce evaporation of any constituents in the damping solution contained in the distribution portion, and wherein the apparatus further comprises:

means for covering substantially all of the reserve portion of the tray to reduce evaporation of any constituents in the damping solution contained in the reserve portion.

30. The apparatus according to claim 23 further comprising refrigerant means mounted to the tray for cooling damping solution contained in the distribution portion of the tray.

31. The apparatus according to claim 23 further comprising a refrigerant evaporator coil mounted below the bottom of the tray for cooling damping solution contained in the tray.

32. An apparatus for supplying a damping solution to a take-up roller of a printing press, comprising in combination:

a damping tray;

partition means in the damping tray for dividing the damping tray into a reserve portion and a distribution portion, the distribution portion having a substantially concave upward facing bottom with a radius;

means for supplying a damping solution to the reserve portion of the tray;

passage means in the partition means for allowing flow of the damping solution from the reserve portion into the distribution portion;

a driven ductor roller mounted to the damping tray within the distribution portion and adapted to be partially immersed in the damping solution in the distribution portion to transfer damping solution the take-up roller;

the ductor roller having a radius only slightly greater than the radius of the concave upward facing bottom and substantially covering the distribution portion to reduce evaporation of the damping solution; and cover means for substantially covering the reserve portion to reduce evaporation of the damping solution in the reserve portion.

33. The apparatus according to claim 32 further comprising refrigerant means mounted to the tray for cooling damping solution contained in the tray.

34. The apparatus according to claim 32 further comprising a refrigerant evaporator coil mounted to the bottom of the tray for cooling damping solution contained in the tray.

35. The apparatus according to claim 32 wherein the passage means has a cross sectional size selected to be sufficiently small so that flow through the passage means occurs only into the distribution portion to replenish the damping solution used by the ductor roller as it applies damping solution to the take-up roller.

* * * * *